US006311657B2

(12) United States Patent
Sugawara et al.

(10) Patent No.: US 6,311,657 B2
(45) Date of Patent: Nov. 6, 2001

(54) LOCK MECHANISM FOR VALVE TIMING REGULATION DEVICE

(75) Inventors: Masafumi Sugawara; Mutsuo Sekiya, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/791,870

(22) Filed: Feb. 26, 2001

Related U.S. Application Data

(63) Continuation of application No. PCT/JP99/03431, filed on Jun. 25, 1999.

(51) Int. Cl.[7] ..... F01L 1/344

(52) U.S. Cl. ..... 123/90.17; 74/568 R; 464/2; 464/160

(58) Field of Search ..... 123/90.15, 90.17, 123/90.31; 74/568 R; 464/1, 2, 160

(56) References Cited

U.S. PATENT DOCUMENTS 6,053,138 * 4/2000 Trzmiel et al. ..... 123/90.17
6,079,382 * 6/2000 Schafer et al. ..... 123/90.17
6,105,543 * 8/2000 Ogawa ..... 123/90.17

FOREIGN PATENT DOCUMENTS 4-107415 9/1992 (JP) .
9-280018 10/1997 (JP) .
9-303118 11/1997 (JP) .

* cited by examiner

*Primary Examiner*—Weilun Lo
(74) *Attorney, Agent, or Firm*—Sughrue, Mion, Zinn, Macpeak & Seas, PLLC

(57) ABSTRACT

The present invention relates to a lock mechanism for a valve timing regulation device which regulates the timing of the opening and closing of engine valves, the lock mechanism locks or releases a first rotating body and a second rotating body in response to the operational condition of an engine. The lock mechanism includes a radial groove 32 provided in either the first rotating body 21 or the second rotating body 24 and extending in a radial direction of the rotating body. A locking member 35 is slidably inserted into the radial groove 32, and the locking member is urged towards a center of the rotating body by an urging means 36. An oil pressure is applied to the locking member 35 in a direction opposite to the urging direction. In such a way, it is possible to assemble the locking member 35 onto an end face in an axial direction other than a vane 24*a* or a shoe 23*a* in either the first rotating body or the second rotating body, as a result, each vane 24*a* or each shoe 23*a* can be formed with approximately the same circumferential length. Thus, it is possible to expand the angular range to be regulated by the valve timing regulation device and to reduce the degree of unbalance in the device by a large amount.

7 Claims, 6 Drawing Sheets

LOCK MECHANISM FOR VALVE TIMING REGULATION DEVICE

CROSS-REFERENCE TO THE RELATED APPLICATION

This application is a continuation of international Application No. PCT/JP99/03431, whose international filing date is Jun. 25, 1999, the disclosures of which Application are incorporated by reference herein.

BACKGROUND OF THE INVENTION

1. Field of the Invention

The present invention relates to a lock mechanism for a valve timing regulation device which varies the opening and closing timing of one or both of an intake valve and an exhaust valve by an actuator in accordance with an operational condition of an engine.

2. Description of Related Art

A lock mechanism for a valve timing regulation device is known which is provided with a rotor and a housing able to rotate relative to a camshaft which opens and closes a valve of an engine system. The rotor and housing are synchronously rotated by locking them in response to engine operating conditions and are relatively rotated by releasing the lock.

FIG. 1 is a cross sectional view along an axial direction showing a lock mechanism for a valve timing regulation device in a first conventional example as disclosed for example in JP-A-9-280018. In the figure, reference numeral 1 denotes a camshaft which drives the opening and closing of a valve in an engine system and 2 is a timing pulley which is rotatably attached on the camshaft 1. A rotational driving force is transmitted from a crank shaft (not shown) of the engine to the timing pulley 2. 3 is a housing which is fixed to rotate integrally with respect to the timing pulley 2. 4 is a rotor which is linked to a tip of the camshaft 1 and which is stored in the housing 3. The rotor 4 has a plurality of vanes 4*a* which extend in a radial direction and slidably abut with a side of the timing pulley 2 and an inner peripheral surface of the housing 3. The rotor 4 can rotate relatively to the housing 3. 5 is a cover which covers the open end of the housing 3. 6 is a through hole which is provided on one vane 4*a* of the rotor 4 and which extends in an axial direction of the camshaft 1. 7 is a locking hole which is provided on the timing pulley 2 and which is communicated with the through hole 6. 8 is a lock pin which is slidably inserted in the through hole. The lock pin 8 is urged by a spring 9 and is inserted into the locking hole 7. The housing 3 and the rotor 4 are locked by the insertion of the lock pin 8 into the locking hole 7, thereby to prevent the relative rotation of them. 10*a* is an oil passage which is connected to the locking hole 7, 10*b* is an oil passage which is connected to the large diameter hole 6*a* of the through hole 6. The oil passages 10*a*, 10*b* are connected to an oil pressure supply means (oil pump) through an oil control valve (not shown). When an oil pressure supplied to the large diameter hole 6*a* of the through hole 6 and the locking hole 7 from each oil passage 10*a*, 10*b* increases to above a predetermined value, the locking pin 8 releases the lock of the rotor 4 and the housing 3 by retracting from the locking hole 7 by the oil pressure against the urging force of the spring 9.

The operation of the first conventional lock mechanism for a valve timing regulation device will be discussed below.

When the engine is stopped, the oil pressure applied to the locking pin 8 is not more than the predetermined value, the locking pin 8 on the rotor side is engaged with the locking hole 7 of the timing pulley 2 by the urging force of the spring 9. Thus, the rotor 4 and the housing 3 integrated with the timing pulley 2 are in a locked state. After this state, when the oil pressure supplied to the large diameter section 6*a* of the through hole 6 and the locking hole 7 through the oil passage 10*a*, 10*b* exceeds the predetermined value by the activation of the oil pump due to engine startup, the locking pin 8 retracts from the locking hole 7 by the oil pressure resisting the urging force of the spring 9. In this way, the lock of the rotor 4 and the housing 3 is released and these components can undergo relative rotation. As a result of this relative rotation, the opening and closing timing of the valve is regulated.

Since the first conventional lock mechanism for a valve timing regulation device is constructed above, it is necessary to store a locking pin 8 in the vane 4*a* (through hole 6) of the rotor 4 to slide along the axial direction of the camshaft 1. The vane 4*a* storing the locking pin 8 must be formed to be longer in the circumferential direction in comparison with other vanes which do not store the locking pin 8. When the length in the circumferential direction is lengthened, not only is the regulated angular range of the valve timing regulation device reduced, but also the balance with respect to the center of rotation of the rotor 4 is lost. Thus, problems with respect to mechanical strength and the generation of vibrations have arisen.

FIG. 2 is a cross sectional view in the radial direction of a lock mechanism for a valve timing regulation device according to a second conventional example as disclosed for example in JP-A-9-303118. Those components which are the same or similar to components in FIG. 1 are denoted by the same reference numerals and further discussion will be omitted. In FIG. 2, reference numerals 3*a*, 3*b* are shoes which protrude from the inner peripheral surface of the housing 3. Of the shoes 3*a*, 3*b*, one shoe 3*a* is formed to be longer in the circumferential direction than the other shoe 3*b* in order to store the lock mechanism. 11 is a pin hole which is provided on the shoe 3*a* and extends in a radial direction of the housing 3. 12 is a locking pin which is inserted slidably in the pin hole 11. 13 is a spring which urges the locking pin 12 in a direction of the rotor 4. 14 is a locking hole provided on the rotor 4. The locking hole 14 is connectable with the pin hole 11. 15 is an oil passage which is connected with the locking hole 14. An oil pressure from the oil pressure control system is supplied to the oil passage 15.

The operation of the second conventional lock mechanism for a valve timing regulation device will be discussed below.

The locking pin 12 on the housing 3 side is inserted into the locking hole 14 of the rotor 4 by the urging force of the spring 13, the housing 3 and the rotor 4 are locked to rotate synchronously. When the oil pressure supplied to the oil passage 15 in response to an operational condition of the engine exceeds a predetermined value, the locking pin 12 is displaced towards an outer peripheral surface of the housing 3 by the oil pressure against the urging force of the spring 13 and the locking pin 12 retracts from the locking hole 14. In such a way, in the same way as the first conventional example, the locking of the rotor 4 and the housing 3 is released and both components are retained in a state allowing relative rotation.

Since the second conventional lock mechanism for a valve timing regulation device is constructed above, of the shoes 3*a*, 3*b* of the housing 3, it is required to make the shoe 3*a* which acts as storage for the lock mechanism to be longer in the circumferential direction than the other shoe 3*b*. When the length in the circumferential direction is lengthened, in the same way as the first conventional example, not only is the regulated angular range of the valve timing regulation device reduced, but also the balance with respect to the center of rotation of the rotor 4 is lost. Thus, problems with respect to mechanical strength and the generation of vibrations have arisen.

SUMMARY OF THE INVENTION

The present invention is proposed to solve the above problems and has the object of providing a lock mechanism for a valve timing regulation device in which a plurality of shoes provided on the housing and a plurality of vanes provided on the rotor have approximately the same length in the circumferential direction. The lock mechanism of the present invention enables the enlargement of the angular range to be regulated by the valve timing regulation device and allows great reductions in the degree of unbalance with respect to the rotational center. Furthermore, problems with respect to mechanical strength and the generation of vibrations are avoided.

The present invention has the further object of providing a lock mechanism for a valve timing regulation device which can accurately and smoothly perform locking and unlocking operations.

The present invention has the further object of providing a lock mechanism for a valve timing regulation device which can improve productivity by the ease molding by sintering or the like and which thus enables reduction in manufacturing costs.

The present invention has the further object of providing a lock mechanism for a valve timing regulation device which enables improvement of the operation of the locking member.

The present invention has the further object of providing a lock mechanism for a valve timing regulation device which enables the application of an oil pressure to a locking member in both an advancing and retarding direction of the rotating body and which can retain or release normal locking when the oil pressure is not less than a predetermined value.

The present invention has the further object of providing a lock mechanism for a valve timing regulation device in which a function of mounting it on one of the first and second rotating bodies and a function of slidable engagement with the other of the first and second rotating bodies can be achieved by a single component.

The present invention has the further object of providing a lock mechanism for a valve timing regulation device which can improve mass production efficiency by the simplification of component structure.

According to the present invention, there is provided a lock mechanism for a valve timing regulation device which performs locking to enable synchronous rotation of a first rotating body and a second rotating body and releases the locking to enable relative rotation of the first rotating body and the second rotating body, the first and second rotating bodies being provided on a rotation shaft for opening and closing engine valves, the lock mechanism comprising: an engaging projection disposed on an axial end face of one of the first rotating body and the second rotating body; a radial groove disposed on an axial end face of the other of the first rotating body and the second rotating body which faces the one of the first rotating body and the second rotating body, the radial groove extending in a radial direction of the rotating body; a circumferential groove extending in a circumferential direction of the rotating body from the radial groove, the circumferential groove being engaged with the engaging projection to allowing sliding of the engaging projection; a locking member which is stored in the radial groove to slide in the radial direction of the rotating body; a guide groove formed on the locking member and selectively communicated with the circumferential groove; an urging means for urging the locking member towards a center of the rotating body from a position in which the guide groove communicates with the circumferential groove; and an oil pressure supply means for applying an oil pressure to the locking member in a direction resisting the urging means.

This type of lock mechanism for a valve timing regulation device has an engaging projection provided on an axial end face of one of the first and second rotating bodies, a radial groove provided on an axial end face of the other of the first and second rotating bodies, and a locking member slidably inserted in the radial groove. Therefore, the formation region of the radial groove on the rotating body can be formed with sufficient mechanical strength by the locking member which is fit into the radial groove. As a result, it is not necessary to lengthen the shoe or the vane storing the locking member so as to be longer in the circumferential direction than other vanes or shoes not storing the locking member. Thus, it is possible to form each vane or each shoe with approximately the same length in the circumferential direction. As a result, the angular range regulated by the valve timing regulation device can be enlarged and it is possible to eliminate the problems such as mechanical strength and the generation of vibration by large reductions in the degree of unbalance with respect to the rotational center of the rotating body. Furthermore, when the oil pressure of the oil pressure control system provided in the valve timing regulation device is not more than a predetermined value, the first rotating body and the second rotating body can be rotated synchronously by the locking member locking the engaging projection by the urging means. When the oil pressure of the oil pressure control system becomes more than the predetermined value, the locking of the engaging projection by the locking member is released by the displacement of the locking member due to the oil pressure resisting the urging means and thus the first and second rotating bodies can rotate relatively to one another. Therefore, it is possible to accurately and smoothly perform both synchronous and relative rotations of the first and second rotating bodies in response to the variation in the oil pressure of the oil pressure control system.

In the lock mechanism for the valve timing regulation device according to the present invention, the circumferential groove may be adapted to extend in a circumferential direction of the rotating body from both sides of the radial groove and to be divided circumferentially by the radial groove. In such a structure, the groove width of the guide groove gradually increases towards one of the divided circumferential grooves.

The lock mechanism for a valve timing regulation device such as the above allows the rapid introduction of the engaging projection, which is not aligned with the guide groove, into the guide groove of the locking member at a time when the locking member is slightly displaced by the oil pressure in a direction which resists the urging means. When the locking member is displaced in the direction resisting the urging means, it is possible to improve the response characteristics of the engaging projection which is not aligned with the guide groove. Further, when the second rotating body is positioned on an advancing side and the engaging projection is not aligned with the guide groove, an oil pressure which can resist the urging force of the urging means may be reduced below the predetermined value. Even in such a case, the second rotating body tends to displace in a retarding direction by the reaction torque of the camshaft, the engaging projection slides on the side wall of the guide groove. As a result, the engaging projection displaces the locking member mechanically in a radial direction towards an outer periphery of the rotating body against the urging force of the urging means. Therefore, even when no oil pressure exists, the locking member can be surely retained in a lock released state up to a position of maximum retardation of the second rotating body.

In the lock mechanism for the valve timing regulation device according to the present invention, the locking member may be formed to be rectangular in cross section, and the radial groove storing the locking member may be formed with a cross sectional shape which is adjusted so that the locking member can slide therein.

According to the lock mechanism for the valve timing regulation device such as the above, it is possible to increase ease of manufacture of dies for molding and die formation of the locking member by sintering metal or the like, productivity can be improved, and costs can be reduced.

In the lock mechanism for the valve timing regulation device according to the present invention, a plate covering the radial groove and the circumferential groove may be interposed between the first rotating body and the second rotating body.

In the lock mechanism for the valve timing regulation device, since the circumferential groove and the exposed surface of the locking member inserted into the radial groove are covered by the plate, it is possible to prevent the advancing/retarding oil chamber provided in the valve timing regulation device from being communicated with the radial groove and the circumferential groove. Furthermore, the sliding of the locking member is improved.

In the lock mechanism for the valve timing regulation device according to the present invention, the plate may be provided with a common oil pressure passage which communicates with each of an advancing oil pressure chamber and a retarding oil pressure chamber, the oil pressure passage may be provided with an oil passage switching valve for switching an oil pressure applying passage to the locking member between the advancing oil pressure chamber and the retarding oil pressure chamber.

This type of lock mechanism for the valve timing regulation device allows selective application of an oil pressure to the locking member from either the advancing oil pressure chamber or the retarding oil pressure chamber. Thus, it is possible to maintain a lock released state of the first rotating body and the second rotating body as long as the applied oil pressure is not less than a predetermined value.

In the lock mechanism for the valve timing regulation device according to the present invention, engaging projections may be provided on both surfaces of the plate. The engaging projection on one face of the plate engages with the guide groove and the circumferential groove. The engaging projection on the other face of the plate is fitted into an engagement hole provided in the rotating body which does not have the radial groove and the circumferential groove. Further, the plate is adapted to rotate together with the rotating body and to rotate relatively to the other rotating body.

In the lock mechanism for the valve timing regulation device, of the engaging projections which are provided on both sides of the plate, the engaging projection other than that engaged with the guide groove and the circumferential groove is engaged with the engagement hole of the rotating body. Thus, it is possible to rotate the plate together with the rotating body with only this mechanism. Namely, it is possible to assemble both components simply.

In the lock mechanism for the valve timing regulation device according to the present invention, the engaging projections may be formed by a single engaging member which passes through the plate.

In the lock mechanism for the valve timing regulation device, it is not necessary to provide an engaging projection for fixing the plate on one rotating body as a separate member from an engaging projection which is engaged with the circumferential groove and the guide groove provided in the other rotating body. As a result, the structure of the unit including the engaging projection and the plate can be simplified by the reduction in the number of components, costs can be reduced and productivity can also be increased.

Detailed Description of the Preferred Embodiment

In order to describe the invention in greater detail, the preferred embodiments will be outlined below with reference to the accompanying figures.

Embodiment 1

Figure 1:
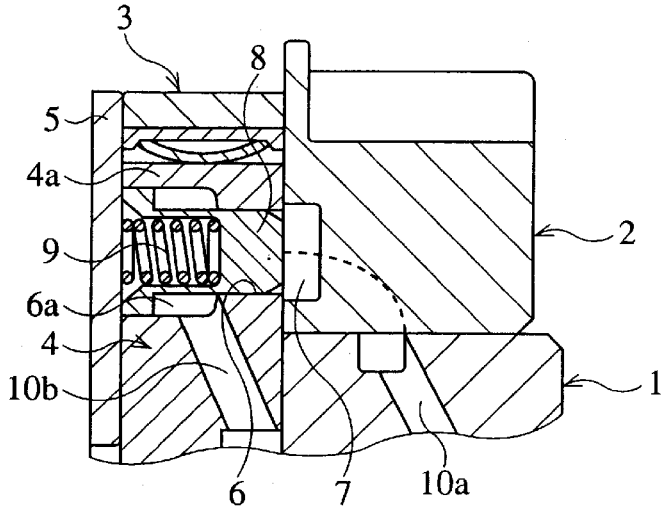
FIG.1 (PRIOR ART)
FIG. 1 is a cross sectional view in the axial direction of a lock mechanism for a valve timing regulation device according to a first conventional example.
Figure 2:
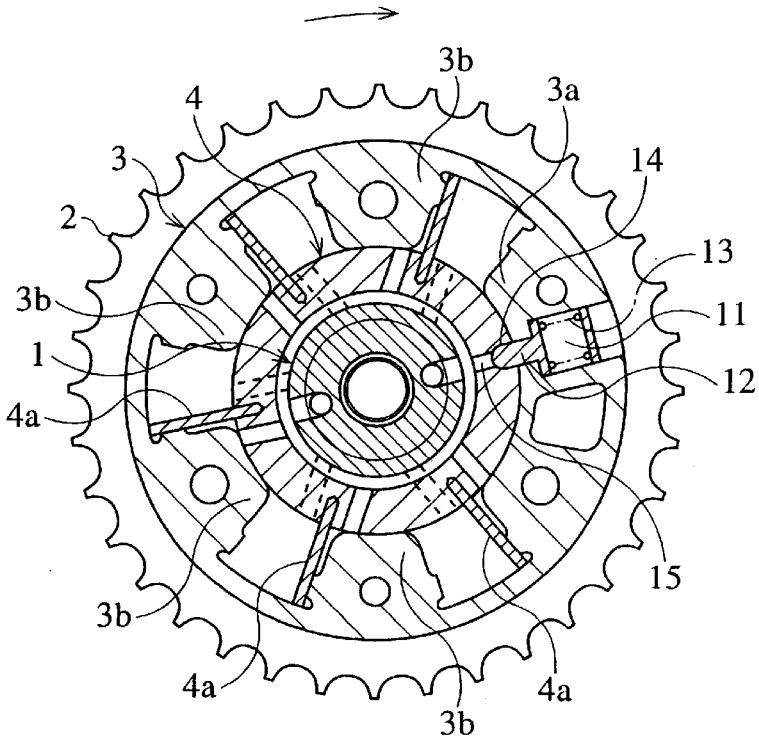
FIG.2 (PRIOR ART)
FIG. 2 is a cross sectional view in the radial direction of a lock mechanism for a valve timing regulation device according to a second conventional example.
Figure 3:
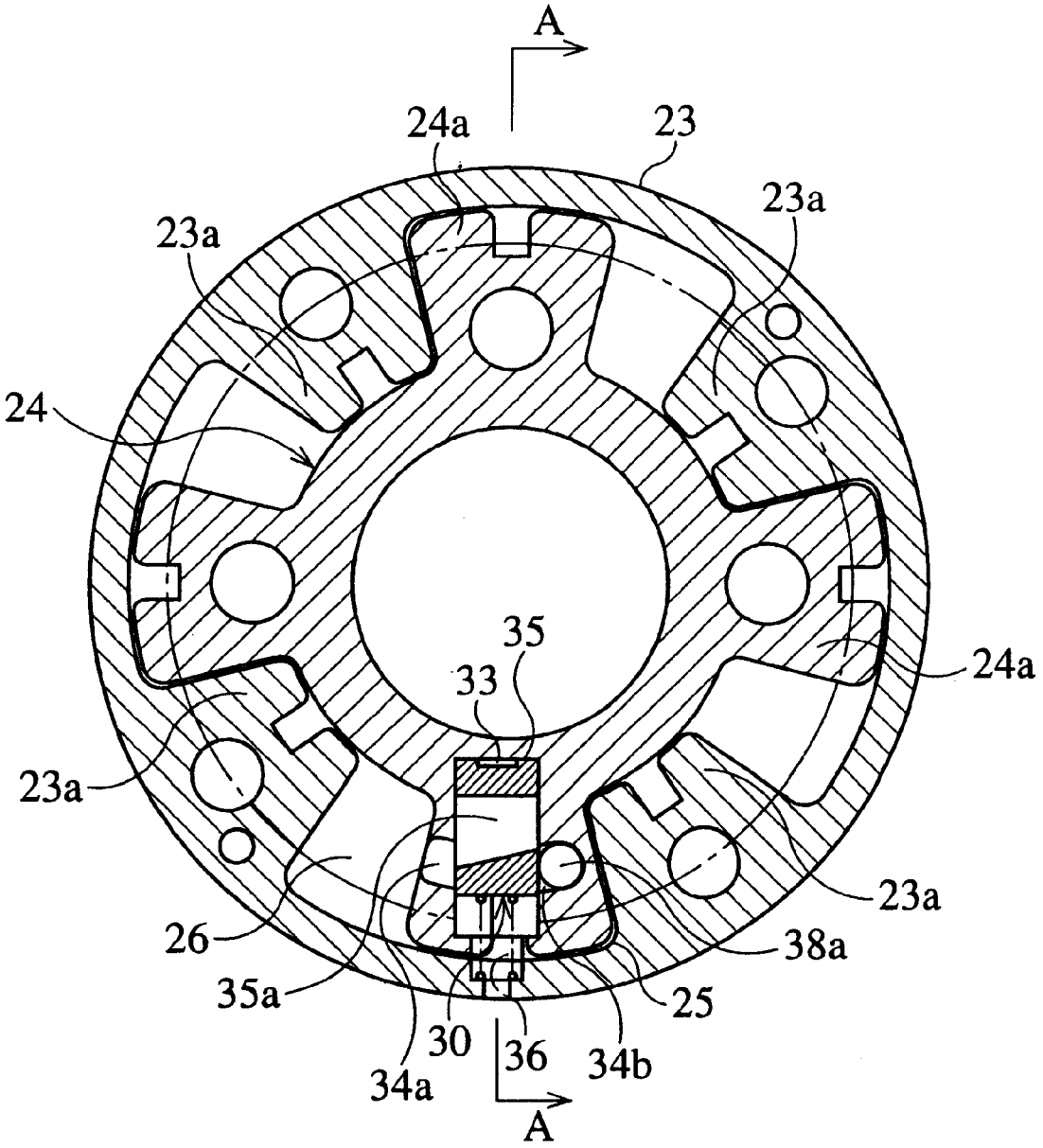
FIG. 3 is a cross sectional view in the radial direction of a lock mechanism for a valve timing regulation device according to a first embodiment of the present invention.
Figure 4:
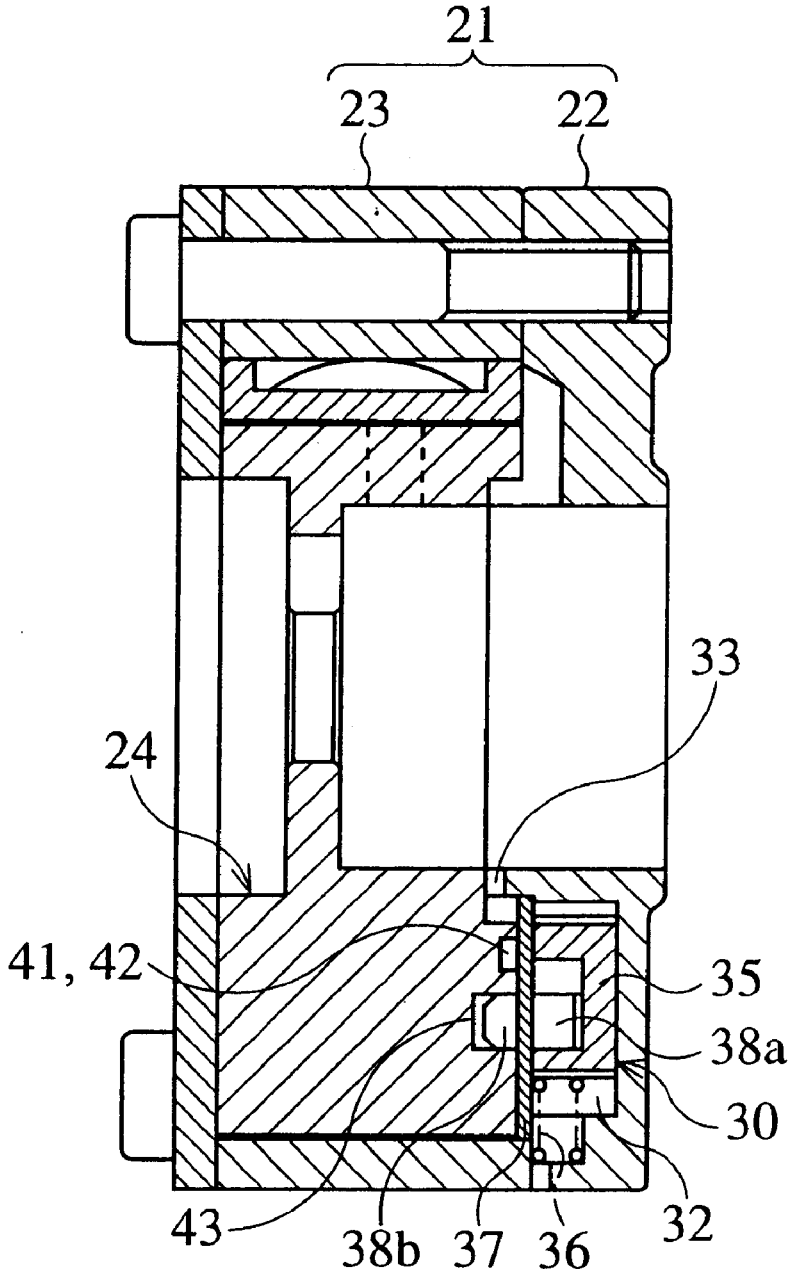
FIG. 4 is a cross sectional view along the line A—A in FIG. 3.

FIG. 3 is a cross sectional view in the radial direction of a lock mechanism for a valve timing regulating device according to a first embodiment of the present invention. FIG. 4 is a cross sectional view along the line A—A in FIG. 3. In the figures, reference numeral 21 denotes a first rotating body which is provided on a camshaft for driving the opening and closing of the valves of an engine. The first rotating body 21 includes a first housing 22 rotatably mounted on the camshaft and a second housing 23 fixed to the first housing 22. 24 is a second rotating body (rotor) which is linked to the camshaft and stored in the second housing 23. The second rotating body 24 is comprised by a rotor which can rotate relatively to the first rotating body 21. 23*a* denotes a plurality of shoes which are disposed at fixed intervals on the inner peripheral surface of the second housing 23 so as to protrude from the inner peripheral surface of the second housing 23. The tips of the shoes 23*a* slidably abut with a body portion of the second rotating body 24. 24*a* denotes a plurality of vanes which are arranged on the body portion of the second rotating body 24 and extend in a radial direction from the body portion of the second rotating body 24. The tips of the vanes 24*a* slidably abut with the inner peripheral surface of the second housing 23. 25 is an advancing oil pressure chamber which rotates each vane 24*a* in an advancing direction. 26 is an retarding oil pressure chamber which rotates each vane 24*a* in a retarding direction. The advancing oil pressure chamber 25 and the retarding oil pressure chamber 26 are formed in a fan shape between each shoe 23*a* and each vane 24*a* and between the second housing 23 and the second rotating body 24.

30 is a lock mechanism which locks the first rotating body 21 and the second rotating body 24 to enable synchronous rotation of the first rotating body 21 and the second rotating body 24 and which allows relative rotation of the first rotating body 21 and the second rotating body 24 by releasing the lock.

Figure 5:
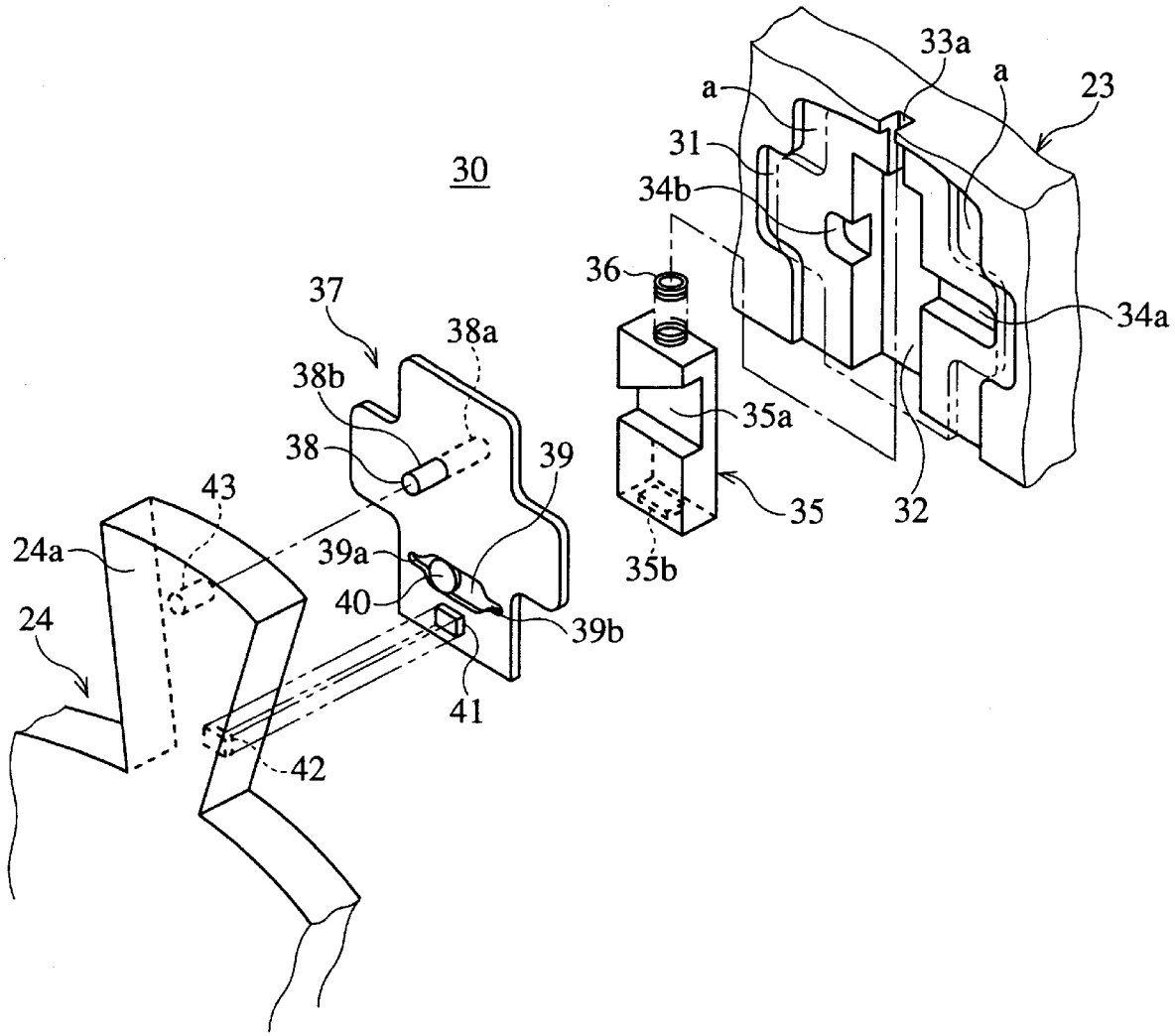
FIG. 5 is an exploded perspective view of a lock mechanism for a valve timing regulation device according to the first embodiment of the present invention.

FIG. 5 is an exploded perspective view of a lock mechanism for a valve timing regulation device according to the first embodiment of the present invention. The lock mechanism as shown in FIG. 5 is shown from a vertical direction opposite to the lock mechanism 30 as shown in FIG. 3 and FIG. 4 but has the same structure. In FIG. 5, 31 denotes a concave portion which is formed on an end face in an axial direction of the second housing 23 and which opens towards an end face in the axial direction of the second rotating body 24. 32 is a radial groove for storage of the locking member which is formed on the bottom face of the concave portion 31 and extends in a radial direction of the housing 23. 33*a* is a drain hole which communicates with the radial groove 32 and opens on an outer peripheral surface of the housing 23. 34*a*, 34*b* are circumferential grooves which branch from both sides of the radial groove 32 and extend in a circumferential direction of the housing 23. The circumferential grooves 34*a*, 34*b* are separated longitudinally by the radial groove 32. One circumferential groove 34*a* extends in an advancing direction and the other circumferential groove 34*b* extends in a retarding direction. 35 is a locking member which is fitted into the radial groove 32. The locking member 35 can slide in the radial direction of the first rotating body 21 within the radial groove 32. The locking member 35 has a quadrangular cross section, and the radial groove 32 which stores the locking member 35 has a cross section (squared groove shape) adapted to the locking member 35. 35*a* is a guide groove which is formed in approximately a central section of the locking member 35. The guide groove 35*a* can communicate mutually with the circumferential grooves 34*a*, 34*b*. After communicating, the lock engaging projection 38*a* (discussed below) can be guided in a direction from one circumferential groove 34*a* to the other circumferential groove 34*b* or in the opposite direction. The guide groove 35*a* is formed to gradually enlarge towards one of the circumferential grooves 34*a*. In this way, the displacement of the lock engaging projection 38*a* from the one of the circumferential grooves 34*a* is facilitated. 35*b* is a pressure receiving portion having a concave shape, which is provided on an end portion of the first rotating body 21 towards a rotational center in the locking member 35. 36 is a spring acting as an urging means which urges the locking member 35 towards the rotational center of the first rotational body 21. In the urged position of the locking member 35 due to the spring 36, the guide groove 35*a* of the locking member 35 does not align with the circumferential groove 34*a*, 34*b* so that the lock engaging projection 38*a* can not pass through the guide groove 35*a*.

37 is a plate which is fitted into the concave portion 31 of the second housing 23. The plate 37 covers the guide groove 35*a* of the locking member 35, the circumferential groove 34*a*, 34*b* and the radial groove 32. 38 is an engaging projection which is provided on the plate 37. The engaging projection 38 is composed of a single engaging member (for example a single pin member) which is fixed through the plate 37. The engaging projection 38 has a lock engaging projection portion 38*a* which projects from one side of the plate 37 towards the second housing 23 and a mounting engaging projection portion 38*b* which projects towards the second rotating body 24 from the other side of the plate 37 in order to fix the plate 37 to the second rotating body 24. The lock engaging projection portion 38*a* is attached to slide with respect to the circumferential grooves 34*a*, 34*b* and the guide groove 35*a* and is locked by the locking member 35.

39 is an oil pressure passage which is provided in the plate 37. The oil pressure passage 39 acts as an oil pressure supply means for supplying an oil pressure to the pressure receiving portion 35*b* of the locking member 35. The oil pressure passage 39 has an advancing chamber communication passage 39*a* which communicates with the advancing oil pressure chamber 25 and an retarding chamber communication passage 39*b* which communicates with the retarding oil pressure chamber 26. 40 is an oil passage switching valve which is provided in the oil pressure passage 39. The oil passage switching valve 40 selectively switches an oil pressure applying passage for applying an oil pressure to the pressure receiving portion 35*b* of the locking member 35 between either the advancing chamber communication passage 39*a* or the retarding chamber communication passage 39*b*.

41 is an engaging protrusion which is integrated with the plate 37 and is disposed at a position apart from the mounting engaging projection portion 38*b*. 42 is an engaging concave portion which is provided on a vane 24*a* of the second rotating body 24 so as to face with the engaging protrusion 41. 43 is an engagement hole which is provided on the vane 24*a* so as to face with the mounting engaging projection portion 38*b*. The mounting engaging projection portion 38*b* is fitted in the engagement hole 43 and the plate 37 is mounted and fixed to the axial direction end face of the second rotating body 24 by the engagement of the engaging protrusion 41 and the engaging concave portion 42. Thus, the plate 37 is inserted into the concave portion 31 of the housing 23 in this state. The plate 37 inserted into the concave portion 31 can be displaced in the circumferential direction of the housing 23 by a fixed distance. That is to say, when the plate 37 is inserted into the concave portion 31, a gap with a distance of a is generated between the wall face in the circumferential direction of the concave portion 31 and the end face in the circumferential direction of the plate 37 as shown by the broken line in FIG. 5. The plate can be displaced in the circumferential direction within the concave portion 31 by the distance a.

In FIG. 3 and FIG. 4, 33 is an oil pressure supply hole which is provided in an inner peripheral portion of the housing 22. The oil pressure supply hole 33 is connected to the radial groove 32 on the opposite side of the drain hole 33*a* and acts as an oil pressure supply means which applies the oil pressure to the locking member 35 in a direction resisting the urging force of the spring 36. The oil pressure supply hole 33 is selectively connected with the advancing oil pressure chamber 25 and the retarding oil pressure chamber 26 through the oil pressure passage 39 of the plate 37 by the oil passage switching valve 40.

Next, the operation of a lock mechanism for a valve timing regulation device according to the first embodiment of the present invention will be described below.

When the oil pressure applied to the locking member 35 from the oil pressure supply hole 33 is not more than a predetermined value, the locking member 35 is maintained by the urging force of the spring 36 in a position obstructing the communication between the right and left circumferential grooves 34*a*, 34*b*. Thus, when the lock engaging projection portion 38*a* is positioned in the circumferential groove 34*b* situated on an retarding side, namely, in a maximum retarding position, the lock engaging projection portion 38*a* is maintained in a locked position by the locking member 35 as shown in FIG. 3 and the first and second rotating bodies 21, 24 rotate synchronously.

Figure 6:
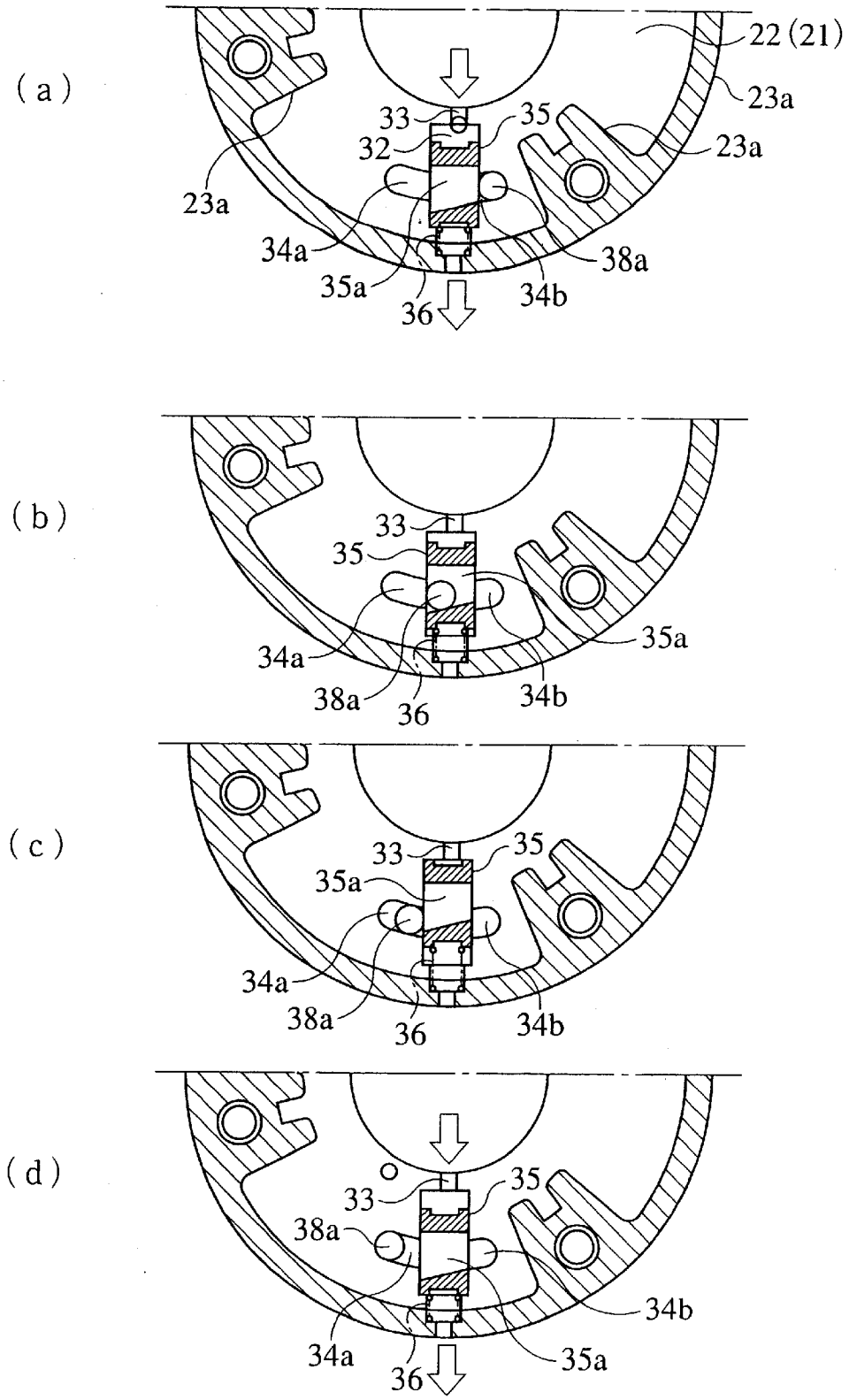
FIG. 6(*a*) to FIG. 6(*d*) are explanatory views describing the operation of the present invention.

When the oil pressure becomes more than the predetermined value, the locking member 35 is displaced by the oil pressure in the radial direction towards an outer periphery of the rotating body against the urging force of the spring 36, the guide groove 35*a* of the locking member 35 communicates with the circumferential grooves 34*a*, 34*b* (refer to FIG. 6(*a*)). In this way, the lock of the lock engaging projection portion 38*a* is released by the locking member 35, the first and second rotating bodies 21, 24 can rotate relatively to each other. Thus, by the rotation of the second rotating body 24 in an advancing direction, the lock engaging projection portion 38*a* displaces, together with the second rotating body 24, from the retarding side circumferential groove 34*b* to the advancing side circumferential groove 34*a* through the guide groove 35*a* of the locking member 35 (refer to FIG. 6 (b), (c)). Then, the lock engaging projection portion 38*a* abuts with the end portion of the circumferential groove 34*a*, the second rotating body 24 is maintained in a maximum advanced position (refer to FIG. 6(*d*)).

As shown above, when the second rotating body 24 rotates from a position situated on a retarding side towards an advancing side, the oil pressure supply hole 33 is connected with the advancing chamber communication passage 39*a* by the oil passage switching valve 40 and an oil pressure is applied to the locking member 35 from the advancing oil pressure chamber 25.

Hereafter, the displacement of the locking member when the second rotating body 24 rotates in a retarding direction will be described.

When the lock engaging projection portion 38*a* separates from the guide groove 35*a* of the locking member 35 and is positioned in the circumferential groove 34*a*, the locking member 35 is retained in a balanced state by the oil pressure applied to its tip and the urging force of the spring 36. Normally, in this state, an oil pressure in the advancing oil pressure chamber 25 or the retarding oil pressure chamber 26 is applied as a lock releasing oil pressure. However, when the applied oil pressure is abnormally reduced or the engine is stopped, the possibility arises that the oil pressure may be reduced to zero. In such a state, it is required to return it quickly to the maximum retarding position and to lock the first and second rotating bodies 21, 24. Thus, in a case where the lock engaging projection portion 38*a* is positioned in the circumferential groove 34*a* and the oil pressure is conspicuously reduced, a reverse rotation force is generated by the reactive force of the camshaft 1 to return the second rotating body 24 to a position situated on a retarding side. As a result, the lock engaging projection portion 38*a* enters the guide groove 35*a* of the locking member 35 and returns to the circumferential groove 34*b* on a maximum retarding side. At this time, even if there is no oil pressure to retain or release the locking member 35, a force is applied by which the lock engaging projection portion 38*a* presses the outer wall face of the guide groove 35*a* in the radial direction towards its outer periphery, and it is possible to displace the locking member 35 mechanically in the radial direction towards the outer periphery of the rotating body against the urging force of the spring 36. Thus, the second rotating body 24 is displaced quickly in the retarding direction and reaches the maximum retarding position. As a result, the engaging projection portion 38*a* is displaced from the guide groove 35*a* of the locking member 35 to the circumferential groove 34*b* on the maximum retarded side. At this time, the locking member 35 is displaced in the radial direction towards a center of the rotating body by the urging force of the spring 36, the movement of the engaging projection portion 38*a* is restricted by the side wall of the locking member 35, and the relative rotation of the first and the second rotating body 21, 24 is restricted.

As described above, according to the first embodiment of the present invention, a radial groove 32 is provided on an axial end face of the first rotating body 21, and a locking member 35 is inserted in the radial groove 32 so as to slide therein. Thus, it is possible to form the radial groove 32 on the axial end face of the first rotating body 21 (first housing 22) in the space region between the shoes 23*a* which are adjacent to each other in the circumferential direction of the first rotating body 21. Namely, it is not necessary to form the radial groove 32 on the shoe 23*a*. As a result, each shoes 23 of the first rotating body 21 (second housing 23) can be formed with approximately the same length in a circumferential direction thereof and it is possible to expand the angular range to be regulated by the valve timing regulation device. Further, it is possible to greatly reduce the degree of unbalance with respect to the rotation center of the first rotating body 21 and thus solve problems such as the mechanical strength and the generation of vibration. Furthermore, according to the first embodiment of the present invention, a circumferential groove 34*a*, 34*b* extends in a circumferential direction of the housing 22 from both sides of the radial groove 32, namely, the circumferential groove 34*a*, 34*b* is divided in the longitudinal direction by the radial groove 32, and the groove width of the guide groove 35*a* gradually increases towards one of the divided circumferential grooves 34*a*. As a result, the lock engaging projection portion 38*a* which is displaced in the expanding direction of the groove width of the guide groove 35*a* can quickly be introduced into the guide groove 35*a* when the locking member 35 is slightly displaced by the oil pressure against the urging force of the spring 36. Thus, the advantage is obtained that the response characteristics of the lock engaging projection portion 38*a* following the displacement of the locking member 35 in a direction resisting the spring 36 are improved. Furthermore, since the locking member 35 has a quadrangular shape in cross section and the radial groove 32 storing the locking member 35 has a cross section adapted to allow sliding of the locking member 35, it is possible to easily mold the locking member by sintered metal or the like, thereby improving a mass production efficiency. In addition, since the manufacture of die for molding is also simplified, the cost can be reduced. Furthermore, according to the first embodiment of the present invention, a plate 37 is interposed between the first and second rotating bodies 21, 24 so as to cover the circumferential grooves 34*a*, 34*b* and the radial groove 32, the circumferential grooves 34*a*, 34*b* and the exposed surface of the locking member 35 inserted into the radial groove 32 are covered with the plate 37. Thus, the communication of the circumferential grooves 34*a*, 34*b* and the radial groove 32 with the advancing oil pressure chamber 25 and the retarding oil pressure chamber 26 can be prevented and it is possible to improve the sliding characteristics of the locking member 35. Furthermore, a common oil pressure passage 39 which communicates with each of the advancing oil pressure chamber 25 and the retarding oil pressure chamber 26 is provided in the plate 37, an oil passage switching valve 40 which switches the oil pressure applying passage to the locking member 35 between either the advancing oil pressure chamber 25 and the retarding oil pressure chamber 26 is provided in the oil pressure passage 39. Thus, it is possible to apply selectively an oil pressure to the locking member 35 from either the advancing oil pressure chamber 25 or the retarding oil pressure chamber 26. Further, it is possible to retain the first rotating body 21 and the second rotating body 24 in a normally lock released state as long as the applied oil pressure is not less than a predetermined value. Furthermore, an engaging projection portion 38 is provided on both surfaces of the plate and one of the engaging projections 38*a* can engage with the guide groove 35*a* and the circumferential grooves 34*a*, 34*b*. The mounting engaging projection portion 38*b* on the opposite side of the plate 37 is engaged and fixed to the engaging hole 43 provided on the second rotating body 24, and the engaging protrusion 41 of the plate 37 is engaged with the engaging concave portion 42 of the second rotating body 24. Thus, it is possible to simply mount the plate 37 on the second rotating body 24 to rotate together with the second rotating body 24. Further, the engagement of the engaging hole 43 with the mounting engaging projection 38*b* and the engagement of the engaging concave portion 42 with the engaging protrusion 41 allow sufficient strength when assembled. Furthermore, the engaging projections 38 are formed by a single engaging member which passes through the plate 37. The lock engaging projection 38*a* projecting from one face of the plate 37 is used for locking, and the mounting engaging projection 38*b* projecting from the opposite face of the plate 37 is engaged with the engagement hole 43. Thus, it is not necessary to provide the lock engaging projection 38*a* and the mounting engaging projection 38*b* as separate members. As a result, the structure of the unit including the engaging projections and the plate is simplified by the reduction in number of components, costs can be reduced, and mass production efficiency can be improved.

Embodiment 2

Figure 7:
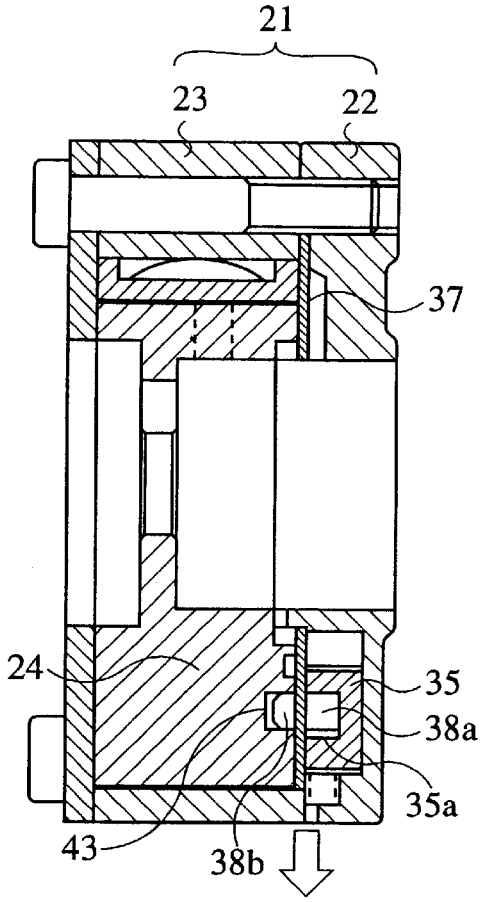
FIG. 7 is a cross sectional view of a lock mechanism for a valve timing regulation device according to a second embodiment of the present invention.

FIG. 7 is a cross sectional view of a lock mechanism for a valve timing regulation device according to a second embodiment of the present invention. In the above first embodiment, a plate 37 is inserted into a concave portion 31 which is formed partially on an end face in an axial direction of the first housing 22 of the first rotating body 21. However, in the second embodiment, the plate 37 is composed of an annular plate which is co-axial with the housing 22, the plate 37 is adapted to rotate in an integrated manner with the second rotating body 24 which slides on the end face in an axial direction of the housing 22 in the circumferential direction. Thus, in the second embodiment, it is possible to obtain the same advantages as the above first embodiment.

Embodiment 3

Figure 8:
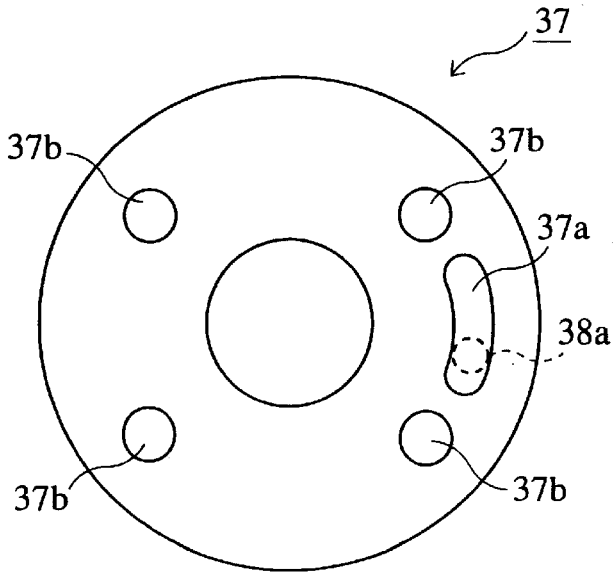
FIG. 8 is a plan view showing a plate of a valve timing regulation device according to a third embodiment of the present invention.

FIG. 8 is a plan view of a plate of a valve timing regulation device according to a third embodiment of the present invention. In the FIG., 37*a* denotes a circumferential slit provided in the annular plate 37, and the lock engaging projection 38*a* is slidably inserted into the circumferential slit. 37*b* denotes a plurality of through holes for bolts provided in the plate 37. The plate 37 is fixed to the housing 22 shown in FIG. 7 by bolts (not shown) through these through holes 37*b*. That is to say, in the above second embodiment, the annular plate 37 is adapted to rotate together with the second rotating body 24. On the other hand, in this third embodiment, the annular plate 37 is disposed between the housing 22 of the first rotating body 21 and the second rotating body (rotor) 24 as shown in FIG. 7 and is adapted to rotate together with the housing 22. In addition, in the third embodiment, the lock engaging projection 38*a* is integrated with the second rotating body 24 and a slit 37*a* is provided on the plate 37 for inserting the lock engaging projection 38*a* so as to slide in the circumferential direction of the plate 37. Thus, in the third embodiment, the same advantage as the first embodiment can be obtained.

In the first embodiment, a lock mechanism 30 is assembled with the first rotating body 21. However, the same advantage can be obtained by assembling the lock mechanism 30 with the second rotating body 24.

As shown above, in a lock mechanism for a valve timing regulation device according to the present invention, it is possible to assemble a locking member onto an end face in an axial direction other than that of a vane or a shoe in either a first rotating body or a second rotating body. As a result, each vane or each shoe can be formed with approximately the same circumferential length. Thus, it is possible to expand the angular range regulated by the valve timing regulation device and to reduce the degree of unbalance in the device by a large amount.

What is claimed is:

1. A lock mechanism for a valve timing regulation device which performs locking to enable synchronous rotation of a first rotating body and a second rotating body and releases the locking to enable relative rotation of the first rotating body and the second rotating body, said first and said second rotating bodies being provided on a rotation shaft for opening and closing engine valves, said lock mechanism comprising:

an engaging projection disposed on an end face in an axial direction of one of the first rotating body and the second rotating body;

a radial groove disposed on an end face in an axial direction of the other of the first rotating body and the second rotating body which faces said one of the first rotating body and the second rotating body, said radial groove extending in a radial direction of said rotating body;

a circumferential groove extending in a circumferential direction of said rotating body from said radial groove, said circumferential groove being engaged with said engaging projection to allowing sliding of said engaging projection;

a locking member which is stored in said radial groove to slide in the radial direction of said rotating body;

a guide groove formed on said locking member and selectively communicated with said circumferential groove;

an urging means for urging said locking member towards a center of said rotating body from a position in which said guide groove communicates with said circumferential groove; and an oil pressure supply means for applying an oil pressure to said locking member in a direction resisting said urging means.

2. The lock mechanism according to claim 1, wherein said circumferential groove extends in the circumferential direction of said rotating body from both sides of said radial groove and is divided longitudinally by said radial groove, and wherein a groove width of said guide groove gradually increases towards one of said divided circumferential grooves.

3. The lock mechanism according to claim 1, wherein said locking member is formed to be rectangular in cross section and said radial groove storing the locking member is formed with a cross sectional shape which is adjusted so that said locking member can slide therein.

4. The lock mechanism according to claim 1, wherein a plate covering said radial groove and said circumferential groove is interposed between said first rotating body and said second rotating body.

5. The lock mechanism according to claim 4, wherein said plate is provided with a common oil pressure passage which communicates with each of an advancing oil pressure chamber and a retarding oil pressure chamber, and said oil pressure passage is provided with an oil passage switching valve for switching an oil pressure applying passage to said locking member between said advancing oil pressure chamber and said retarding oil pressure chamber.

6. The lock mechanism according to claim 4, wherein engaging projections are provided on both surfaces of said plate, said engaging projection on one surface of said plate engaging with said guide groove and said circumferential groove, said engaging projection on the other surface of said plate being fitted into an engagement hole provided in the rotating body which does not have the radial groove and the circumferential groove, and wherein said plate is adapted to rotate together with said rotating body and to rotate relatively to the other rotating body.

7. The lock mechanism according to claim 6, wherein said engaging projections are formed by a single engaging member which passes through said plate.

* * * * *